US009160123B1

(12) United States Patent
Pao et al.

(10) Patent No.: US 9,160,123 B1
(45) Date of Patent: Oct. 13, 2015

(54) COMMUNICATION CONNECTOR AND TRANSMISSION WAFER THEREOF

(71) Applicant: TOPCONN ELECTRONIC (KUNSHAN) CO., LTD., Suzhou,Jiangsu Province (CN)

(72) Inventors: Chung-Nan Pao, New Taipei (TW); Wei Wang, Suzhou (CN); Sun-Yu Chou, New Taipei (TW)

(73) Assignee: TOPCONN ELECTRONIC (KUNSHAN) CO., LTD., Suzhou, Jiangsu Province (CN)

( * ) Notice: Subject to any disclaimer, the term of this patent is extended or adjusted under 35 U.S.C. 154(b) by 0 days.

(21) Appl. No.: 14/336,061

(22) Filed: Jul. 21, 2014

(51) Int. Cl.

| | |
|---|---|
| ***H01R 13/648*** | (2006.01) |
| ***H01R 24/66*** | (2011.01) |
| ***H01R 12/71*** | (2011.01) |
| ***H01R 13/658*** | (2011.01) |

(52) U.S. Cl.
CPC ..... *H01R 24/66* (2013.01); *H01R 12/716* (2013.01); *H01R 13/65802* (2013.01)

(58) Field of Classification Search
CPC ..... H01R 12/716; H01R 13/65802
USPC ..... 439/607.08, 626, 941, 637
See application file for complete search history.

(56) References Cited

U.S. PATENT DOCUMENTS

| | | | | |
|---|---|---|---|---|
| 6,099,328 | A * | 8/2000 | Nelson et al. | 439/637 |
| 6,439,930 | B1 * | 8/2002 | Korsunsky et al. | 439/637 |
| 2012/0034820 | A1 * | 2/2012 | Lang et al. | 439/660 |

* cited by examiner

*Primary Examiner* — Tho D Ta
(74) *Attorney, Agent, or Firm* — Li & Cai Intellectual Property (USA) Office

(57) ABSTRACT

A communication connector includes an outer casing and a plurality of transmission wafers inserted into the outer casing. The transmission wafers are provided for receiving a mating connector along an inserting direction. Each communication wafer includes at least two terminals in coplanar arrangement, and each terminal has a straight segment. The straight segments of the terminals are respectively arranged in a first acute angle and a second acute angle with respective to the inserting direction, in which the first acute angle is smaller than the second acute angle. Two virtual lines, which are respectively defined by extending from the straight segments along the longitudinal directions thereof, are intersecting to form an angle. The angle is the difference of the first and second acute angles. Thus, the communication connector provided by the instant disclosure is produced easily.

19 Claims, 11 Drawing Sheets

COMMUNICATION CONNECTOR AND TRANSMISSION WAFER THEREOF

BACKGROUND OF THE DISCLOSURE

1. Field of the Disclosure

The instant disclosure relates to an electrical connector; more particular, to a communication connector and a transmission wafer thereof.

2. Description of Related Art

The conventional communication connecting device includes two communication connectors for transmitting signal by inserting to each other. Each communication connector has a plurality of conductive terminals, and the manufacturing complexity of each the communication connector is related to the construction and the relative position design of the conductive terminals. Thus, how to manufacture the conductive terminals more easily without affecting the signal transmission effect by changing the construction and the relative position design thereof has become one of the main research directions in the connector field.

To achieve the abovementioned improvement, the inventors strive through industrial experience and academic research to present the instant disclosure, which can provide additional improvement as mentioned above.

SUMMARY OF THE DISCLOSURE

One embodiment of the instant disclosure provides a communication connector and a transmission wafer thereof, which are produced easily without affecting the signal transmission effect.

The communication connector comprises: an outer casing having a base portion and an inserting portion extended from the base portion, wherein a space surrounded by the base portion is communicated with the a space surrounded by the inserting portion; and a plurality of transmission wafers stacked and arranged in one row, the stacked transmission wafers inserted into the outer casing and defining with an inserting direction, thereby a mating connector could be inserted into the inserting portion along the inserting direction and to contact the communication wafers, wherein each transmission wafer comprising: at least one first conductive terminal having a first mating segment, a first straight segment, and a first positioning segment, wherein a longitudinal direction of the first mating segment is approximately parallel to the inserting direction, the first mating segment is arranged in the inserting portion and exposed from the inserting portion, wherein the first straight segment is arranged in the base portion and extended from the first mating segment to one end of the base portion away from the inserting portion, a first acute angle is defined by the first straight segment and the inserting direction, and wherein the first positioning segment is extended from the first straight segment and at least partially exposed from the base portion; and at least one second conductive terminal having a second mating segment, a second straight segment, and a second positioning segment, wherein a longitudinal direction of the second mating segment is approximately parallel to the inserting direction, the second mating segment is arranged in the inserting portion and exposed from the inserting portion, wherein the second straight segment is arranged in the base portion and extended from the second mating segment to one end of the base portion away from the inserting portion, a second acute angle is defined by the second straight segment and the inserting direction, and wherein the second positioning segment is extended from the second straight segment and at least partially exposed from the base portion, wherein the first conductive terminal and the second conductive terminal are substantially in coplanar arrangement, the first acute angle is smaller than the second acute angle; two virtual lines respectively defined by extending from the first and second straight segments along the longitudinal directions thereof are intersecting to form an angle, and wherein the angle is the difference of the first and second acute angles.

The transmission wafer of a communication connector, defining an inserting direction for providing a mating connector to insert into the transmission wafer along the inserting direction, comprises: at least one first conductive terminal integrally formed in one piece and having a first mating segment, a first straight segment, and a first positioning segment in sequence, wherein a longitudinal direction of the first mating segment is approximately parallel to the inserting direction, the first straight segment is extended from the first mating segment along a first acute angle defined by the first straight segment and the inserting direction, the first positioning segment is extended from the first straight segment; at least one second conductive terminal integrally formed in one piece and having a second mating segment, a second straight segment, and a second positioning segment in sequence, wherein a longitudinal direction of the second mating segment is approximately parallel to the inserting direction, the second straight segment is extended from the second mating segment along a second acute angle defined by the second straight segment and the inserting direction, the second positioning segment is extended from the second straight segment; and an insulating body covering at least part of the outer surface of the first straight segment of the first conductive terminal and at least part of the outer surface of the second straight segment of the second conductive terminal, thereby maintaining the relative position of the first and second conductive terminals, wherein the first conductive terminal and the second conductive terminal are substantially in coplanar arrangement, the first acute angle is smaller than the second acute angle; two virtual lines respectively defined by extending from the first and second straight segments along the longitudinal directions thereof are intersecting to form an angle, and wherein the angle is the difference of the first and second acute angles.

Base on the above, the portions of the first and second conductive terminals embedded in the insulating body are respectively formed to be straight as the first and second straight segments, so that the first and second conductive terminals are easily to align when disposed in the mold, thereby simplifying the construction of the mold for forming the insulating body. Furthermore, the signal transmission of the communication connector can achieve the designer's demand by the relative design of the first and second straight segments (e.g., the first acute angle smaller than the second acute angle) provided from the instant embodiment.

Moreover, the first straight segment and the second straight segment do not have any curve portion, such that the energy loss and signal interference can be reduce in said straight segments during signal transmission.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

Figure 1:
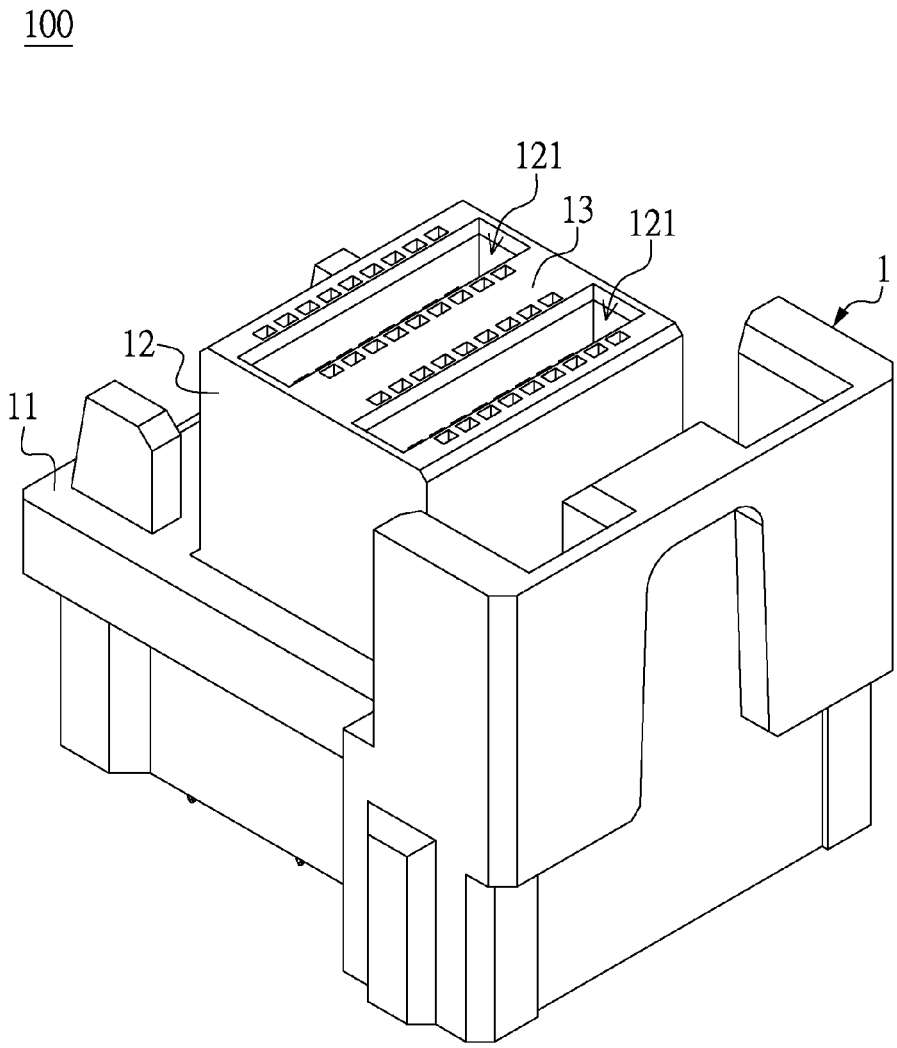
FIG. 1 is a perspective view showing a communication connector according to the instant disclosure.
Figure 2:
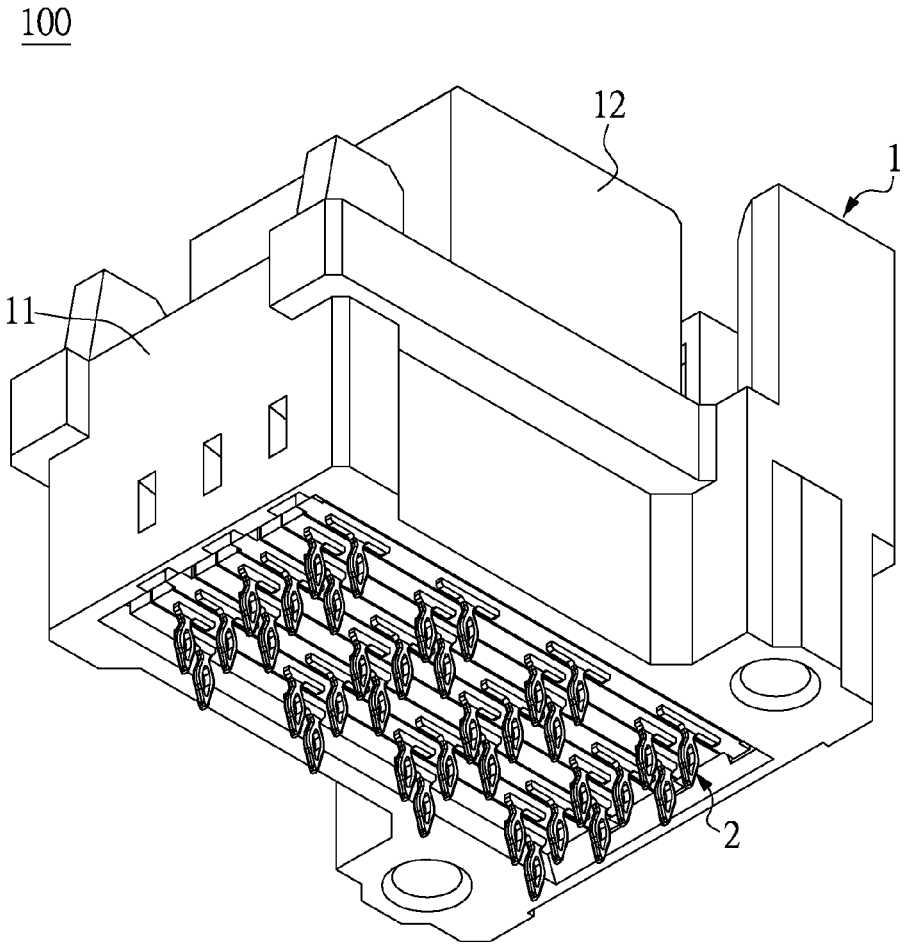
FIG. 2 is a perspective view showing the communication connector in different viewing angle according to the instant disclosure.

Please refer to FIGS. 1 and 2, which show an embodiment of the instant disclosure. The aforementioned illustrations and following detailed descriptions are exemplary for the purpose of further explaining the scope of the instant disclosure. Other objectives and advantages related to the instant disclosure will be illustrated in the subsequent descriptions and appended drawings. In the drawings, the size and relative sizes of layers and regions may be exaggerated for clarity.

The instant embodiment provides a communication connector 100 for perpendicularly installing on a circuit board (not shown), such as a vertical communication connector, and the figures of the instant embodiment takes a mini SAS HD connector applied to high frequency communication for example, but the type of the communication connector 100 is not limited thereto. The communication connector 100 includes an outer casing 1 and a plurality of transmission modules 2 inserted into the outer casing 1. The following description discloses the construction of the outer casing 1 and the construction of each transmission modules 2 firstly, and then discloses the relationship between the outer casing 1 and the transmission modules 2.

Figure 3:
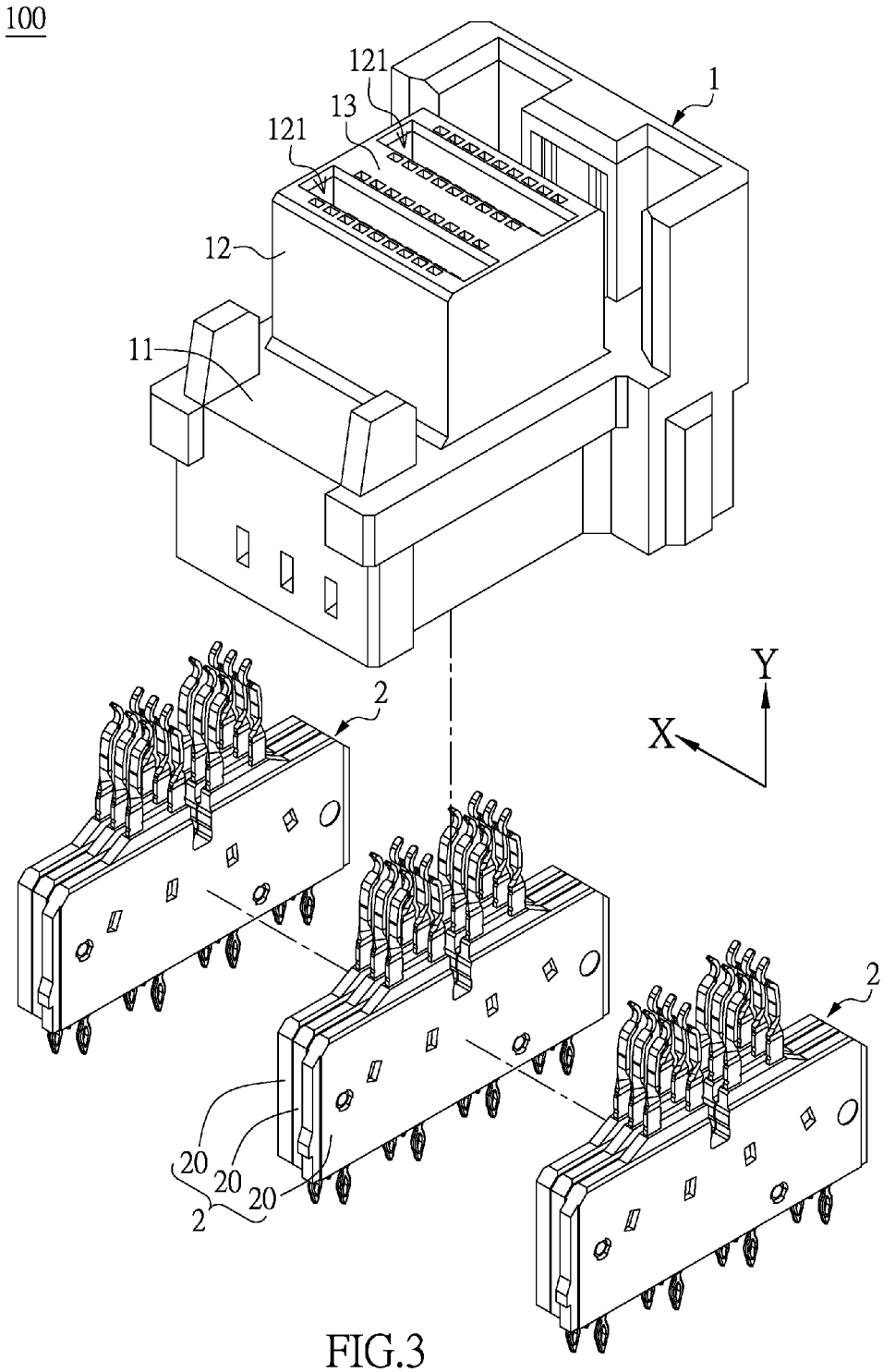
FIG. 3 is an exploded view of FIG. 1.
Figure 4:
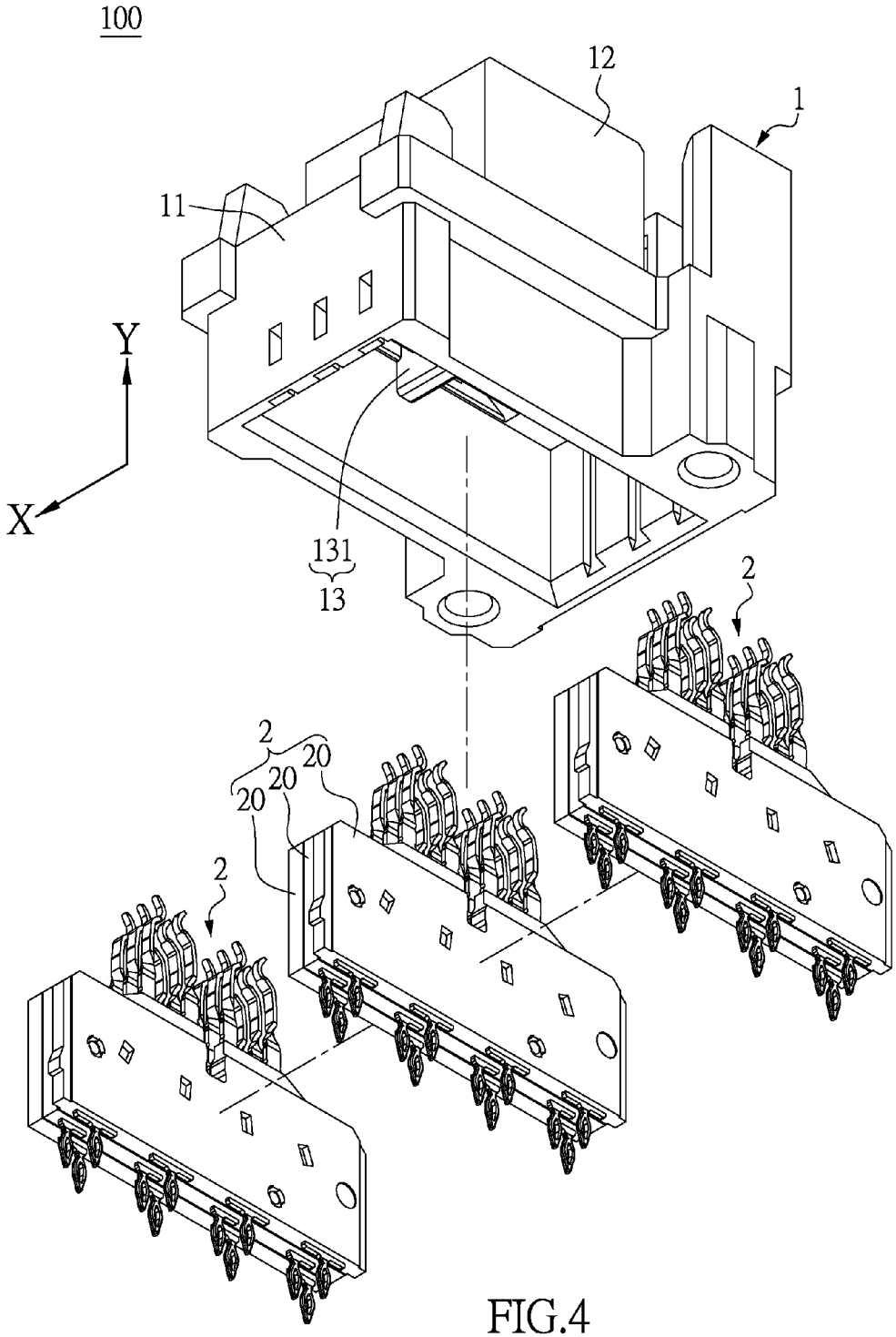
FIG. 4 is an exploded view of FIG. 2.

Please refer to FIGS. 3 and 4. Each transmission module 2 includes three transmission wafers 20, and the transmission wafers 20 of the transmission modules 2 are stacked in one row along a coupling direction X. The row of the transmission wafers 20 in the embodiment are defined based on the function thereof as two signal wafers, one grounding wafer, two signal wafers, one grounding wafer, two signal wafers, and one grounding wafer in sequence along the coupling direction X (i.e., from left to right in FIG. 3). In other words, the three transmission wafers 20 of each transmission module 2 are respectively defined as two signal wafers and one grounding wafer. Each two stacked signal wafers are configured to transmit differential signals. When the two stacked signal wafers transmit differential signals, one of the stacked signal wafers couples another one signal wafer along the coupling direction X.

Moreover, each transmission wafer 20 defines an inserting direction Y perpendicular to the coupling direction X, that can be said, the transmission wafers 20 co-define the inserting direction Y for providing a mating connector (not shown) to insert into and to contact the transmission wafers 20 along the inserting direction Y. It should be noted that, the transmission wafers 20 are approximately the same (just the following said positioning segment of each transmission wafer 20 may be different), such that the following description just discloses the construction of one of the transmission wafers 20.

Figure 5:
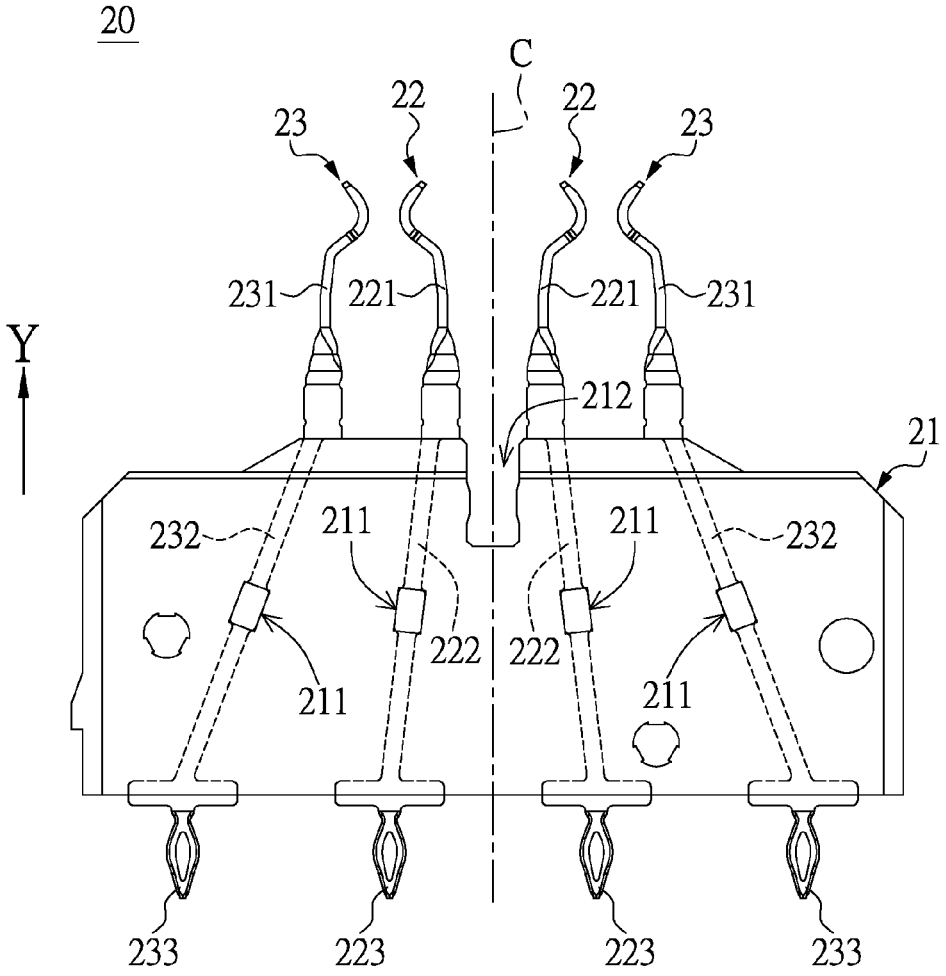
FIG. 5 is a perspective view showing a transmission wafer according to the instant disclosure.
Figure 6:
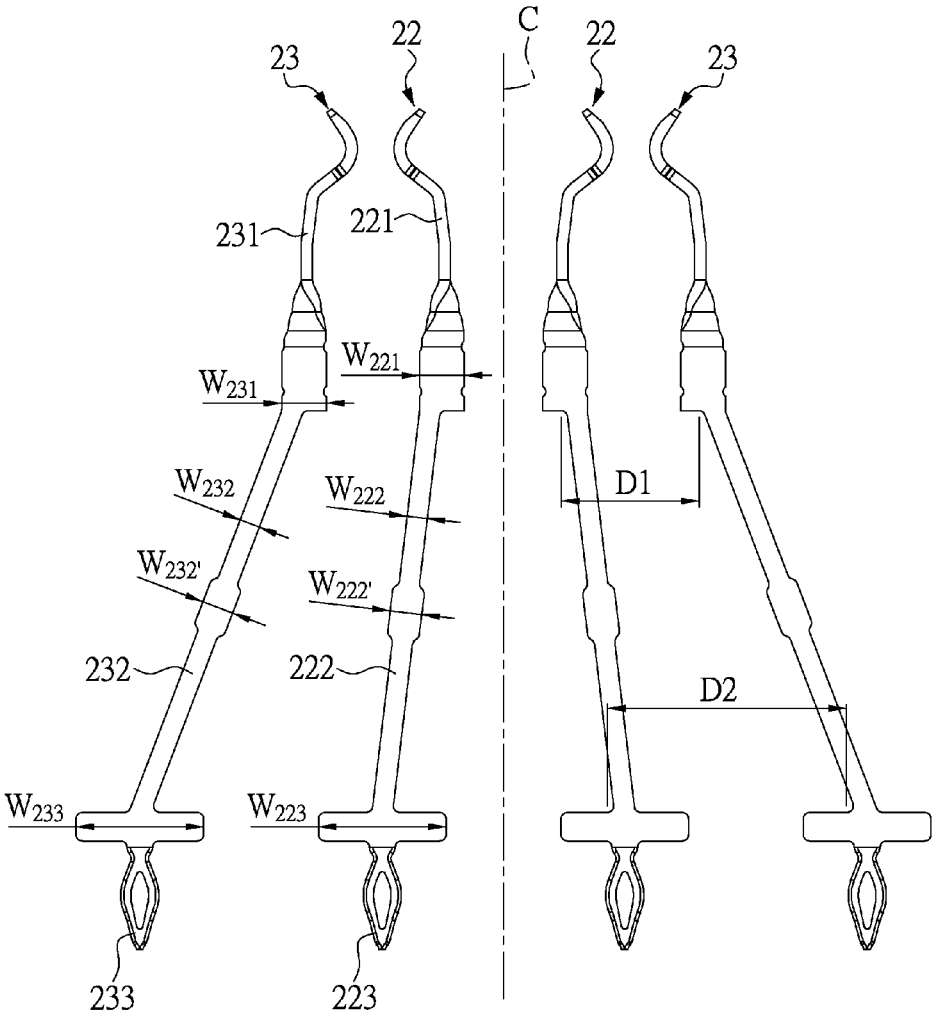
FIG. 6 is a perspective view showing a first conductive terminal and a second conductive terminal of the transmission wafer of FIG. 5.
Figure 7:
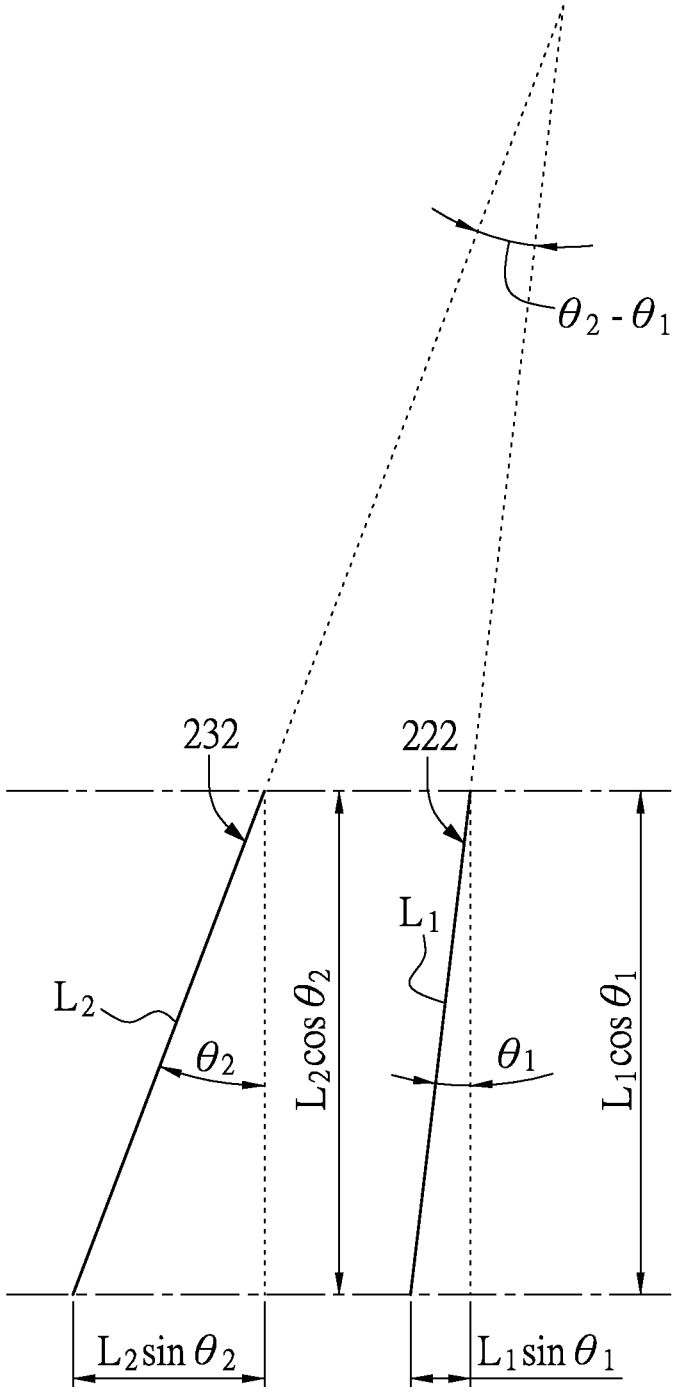
FIG. 7 is a perspective view showing the relationship of the first straight segment and the second straight segment of FIG. 5.

Please refer to FIGS. 5 and 6, and with reference occasionally made to FIG. 7 as disclosing the features about angle. The transmission wafer 20 defines a central axis C parallel to the inserting direction Y, and the transmission wafer 20 is symmetrical to the central axis C. The transmission wafer 20 has two elongated first conductive terminals 22, two elongated second conductive terminals 23, and a sheet-like insulating body 21. The first conductive terminals 22 and the second conductive terminals 23 are substantially arranged in one row and in coplanar arrangement. Specifically, the first conductive terminals 22 are respectively arranged at two opposing sides of the central axis C, and the first conductive terminals 22 are mirror symmetrical to the central axis C. The second conductive terminals 23 are respectively arranged at two opposing outer sides of the first conductive terminals 22, and the second conductive terminals 23 are mirror symmetrical to the central axis C.

Thus, via the first conductive terminals 22 respectively arranged at two opposing sides of the central axis C and the second conductive terminals 23 respectively arranged at two opposing outer sides of the first conductive terminals 22, the mold flow could be uniform to reduce the probability of the warping deformation of the insulating body 21 when forming the insulating body 21 to cover part of each first conductive terminal 22 and part of each conductive terminal 23.

It should be noted that, the first conductive terminal 22 and the second conductive terminal 23 arranged at one side of the central axis C (i.e., the left side of the central axis C as shown in FIG. 5) are symmetrical to the first conductive terminal 22 and the second conductive terminal 23 arranged at another side of the central axis C (i.e., the right side of the central axis C as shown in FIG. 5), so that the following description just discloses the first conductive terminal 22 and the second conductive terminal 23 arranged at one side of the central axis C (i.e., the left side of the central axis C as shown in FIG. 5).

The first conductive terminal 22 formed in one piece integrally, and has a first mating segment 221, a first straight segment 222, and a first positioning segment 223 in sequence. A longitudinal direction of the first mating segment 221 is approximately parallel to the inserting direction Y, the first straight segment 222 is extended from one end portion of the first mating segment 221 (i.e., the bottom end portion of the first mating segment 221 as shown in FIG. 5) along a first acute angle $\theta_1$ (as shown in FIG. 7) defined by the first straight segment 222 and the inserting direction Y, and the first positioning segment 223 is extended from one end portion of the first straight segment 222 (i.e., the bottom end portion of the first straight segment 222 as shown in FIG. 5).

Moreover, the widths $W_{222}$ and $W_{222'}$ of the first straight segment 222 are narrower than the width $W_{221}$ of a portion of the first mating segment 221 adjacent thereto, and the widths $W_{222}$ and $W_{222'}$ of the first straight segment 222 are also narrower than the width $W_{223}$ of a portion of the first positioning segment 223 adjacent thereto. In the instant embodiment, the width $W_{222}$ of the end portion of the first straight segment 222 is substantially 50% of the width $W_{221}$ of the adjacent portion of the first mating segment 221. In other words, the width $W_{222}$ of two opposing end portions of the first straight segment 222 (i.e., the top and bottom end portions of the straight segment 222 as shown in FIGS. 5 and 6) are respectively narrower than the width $W_{221}$ of the adjacent portion of the first mating segment 221 and the width $W_{223}$ of the adjacent portion of the first positioning segment 223.

Additionally, the width said in the instant embodiment represents the distance between two opposing narrow side surfaces of the conductive terminal. For example, as shown in FIG. 6, the distance between the left side edge and the right side edge of the first straight segment 222 is defined as the width $W_{222}$ or $W_{222'}$.

The second conductive terminal 23 formed in one piece integrally, and has a second mating segment 231, a second straight segment 232, and a second positioning segment 233 in sequence. A longitudinal direction of the second mating segment 231 is approximately parallel to the inserting direction Y, the second straight segment 232 is extended from one end portion of the second mating segment 231 (i.e., the bottom end portion of the second mating segment 231 as shown in FIG. 5) along a second acute angle $\theta_2$ (as shown in FIG. 7) defined by the second straight segment 232 and the inserting direction Y, and the second positioning segment 233 is extended from one end portion of the second straight segment 232 (i.e., the bottom end portion of the second straight segment 232 as shown in FIG. 5).

Moreover, the widths $W_{232}$ and $W_{232'}$ of the second straight segment 232 are narrower than the width $W_{231}$ of a portion of the second mating segment 231 adjacent thereto, and the widths $W_{232}$ and $W_{232'}$ of the second straight segment 232 are also narrower than the width $W_{233}$ of a portion of the second positioning segment 233 adjacent thereto. In the instant embodiment, the width $W_{232}$ of the end portion of the second straight segment 232 is substantially 50% of the width $W_{231}$ of the adjacent portion of the second mating segment 231. In other words, the width $W_{232}$ of two opposing end portions of the second straight segment 232 (i.e., the top and bottom end portions of the second straight segment 232 as shown in FIGS. 5 and 6) are respectively narrower than the width $W_{231}$ of the adjacent portion of the second mating segment 231 and the width $W_{233}$ of the adjacent portion of the second positioning segment 233.

Specifically, please refer to FIGS. 6 and 7, wherein the FIG. 7 shows the relationship between the first straight segment 222 and the second straight segment 232 of FIG. 6. The first straight segment 222 is non-parallel to the second straight segment 232. The first acute angle $\theta_1$ is smaller than the second acute angle $\theta_2$. Two virtual lines, which are respectively defined by extending from the first and second straight segments 222, 232 along the longitudinal directions thereof, are intersecting to form an angle, and the angle is the difference of the first and second acute angles $\theta_1$, $\theta_2$.

Moreover, the first straight segment 222 of the first conductive terminal 22 has a first length $L_1$, the second straight segment 232 of the second conductive terminal 23 has a second length $L_2$. The relationship of the first length $L_1$, the second length $L_2$, the first acute angle $\theta_1$, and the second acute angle $\theta_2$ conforms to a first formula E1, and the first formula E1 is $L_1 \cos \theta_1 = L_2 \cos \theta_2$.

From another observation, a distance $D_1$ between one end of the first straight segment 222 connected to the first mating segment 221 (i.e., the top end of the first straight segment 222 as shown in FIG. 6) and one end of the second straight segment 232 connected to the second mating segment 231 (i.e., the top end of the second straight segment 232 as shown in FIG. 6) is smaller than a distance D2 between another end of the first straight segment 222 connected to the first positioning segment 223 (i.e., the bottom end of the first straight segment 222 as shown in FIG. 6) and another end of the second straight segment 232 connected to the second positioning segment 233 (i.e., the bottom end of the second straight segment 232 as shown in FIG. 6). That is to say, by means of the first acute angle $\theta_1$ being smaller than the second acute angle $\theta_2$, the distance between the first straight segment 222 and the second straight segment 232 increases from top to bottom gradually, and result in $D_2 > D_1$ as shown in FIG. 6.

Preferably, under the said condition $D_2 > D_1$ in the instant embodiment, a additional relationship between the first length $L_1$, the second length $L_2$, the first acute angle $\theta_1$, and the second acute angle $\theta_2$ is conformed to a second formula E2, wherein the second formula E2 is $L_2 \sin \theta_2 = NL_1 \sin \theta_1$, $2 \leq N \leq 5$. Specifically, the type as shown in FIG. 7 has a condition: N=3.2.

It should be noted that the first formula E1 and the second formula E2 indicate the two different viewpoints of the relationship between the first straight segment 222 and the second straight segment 232, therefore, since the preferable embodiment in the instant disclosure conforms to both the first formula E1 and the second formula E2 (as shown in FIG. 7) at the same time, the disclosure in the present invention may also conform to only one of the first formula E1 and the second formula E2 respectively.

Figure 8:
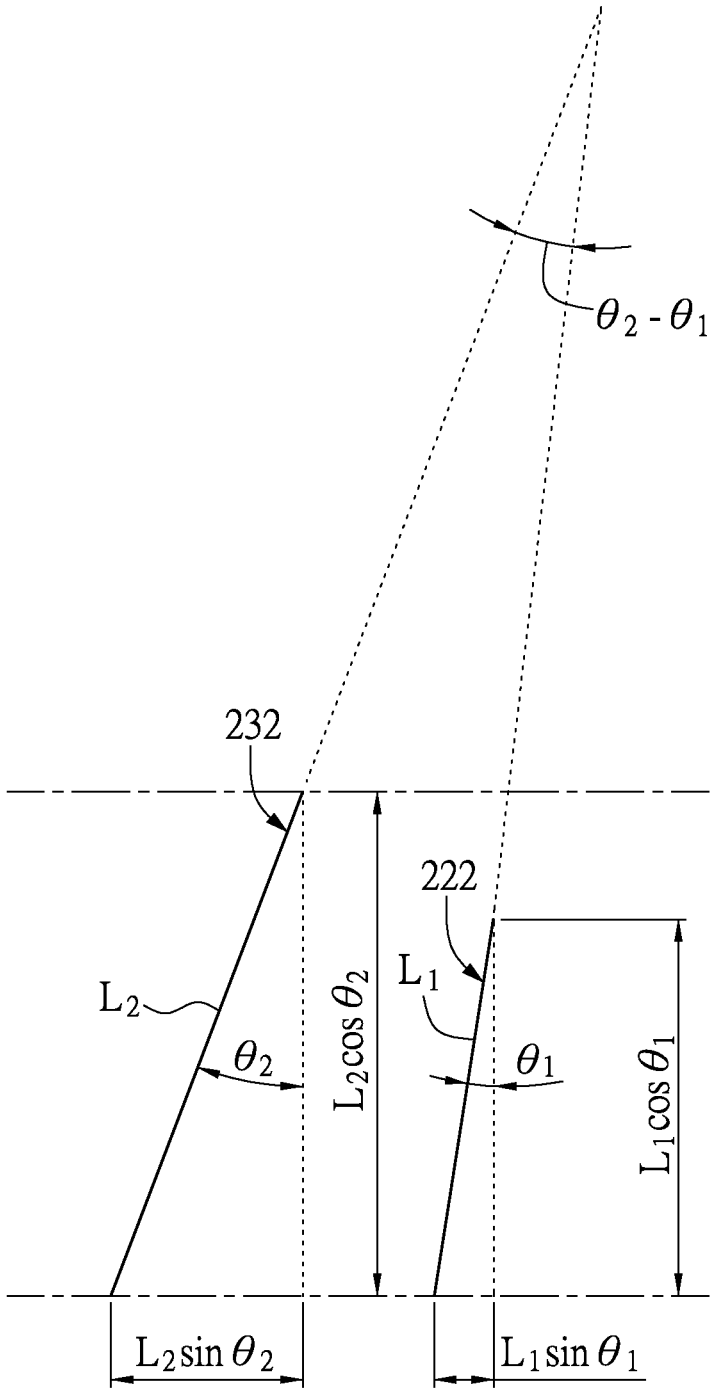
FIG. 8 is a perspective view showing the relationship of the first straight segment and the second straight segment in another type.
Figure 9:
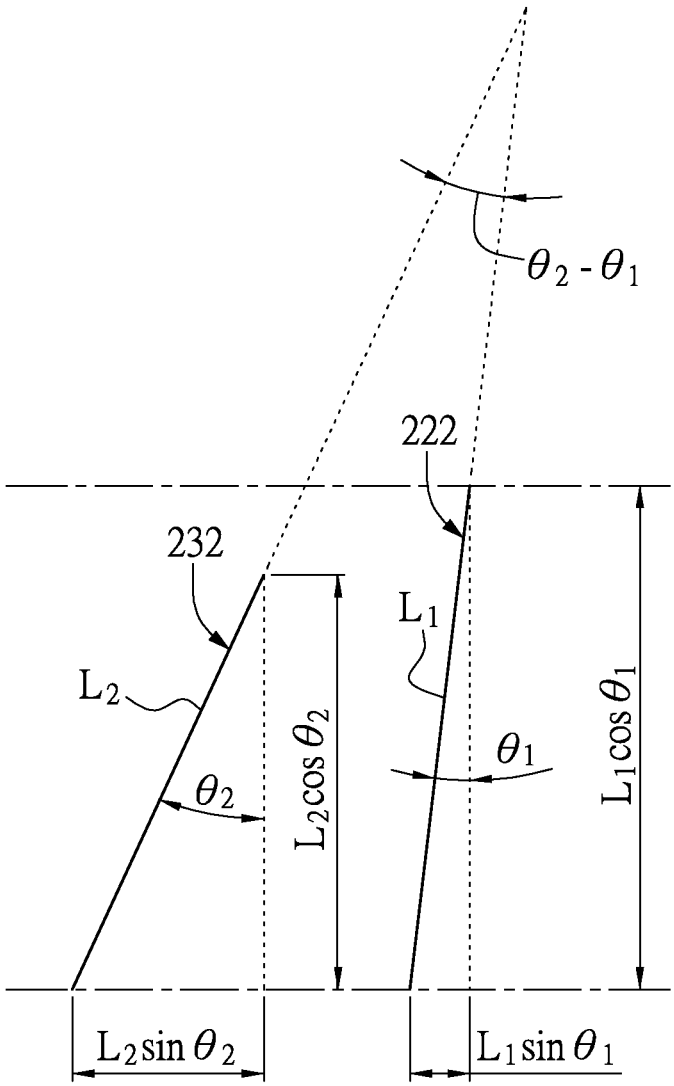
FIG. 9 is a perspective view showing the relationship of the first straight segment and the second straight segment in still another type.

For example, please refer to FIG. 8, showing the embodiment conforming to the second formula E2 but not conforming to the first formula E1 ($L_1 \cos \theta_1 < L_2 \cos \theta_2$). Specifically, the first mating segment 221 has a length longer than the length of the second mating segment 231 by downwardly extending along the inserting direction Y. Moreover, please refer to FIG. 9, showing the embodiment conforming to the second formula E2 but not conforming to the first formula E1 ($L_1 \cos \theta_1 > L_2 \cos \theta_2$). Specifically, the second mating segment 231 has a length longer than the length of the first mating segment 221 by downwardly extending along the inserting direction Y. Besides, in a non-shown embodiment, the relationship between the first straight segment 222 and the second straight segment 232 may only conform to the first formula E1 but not conform to the second formula E2.

The portions of the first and second conductive terminals 22, 23 embedded in the insulating body 21 are respectively the first and second straight segments 222, 232, and the first and second straight segments 222, 232 conform to the predetermined conditions (e.g., the first acute angle $\theta_1$ smaller than the second acute angle $\theta_2$), so that the first and second conductive terminals 22, 23 are easily to align while disposed in the mold, thereby simplifying the construction of the mold for forming the insulating body 21. Furthermore, the signal transmission of the communication connector 100 can achieve the designer's demand by the arrangement of the relative position of the first and second straight segments 222, 232 (e.g., the first acute angle $\theta_1$ smaller than the second acute angle $\theta_2$) provided from the instant embodiment.

Moreover, the first straight segment 222 and the second straight segment 232 do not have any curve portion, such that the first straight segment 222 and the second straight segment 232 can reduce energy loss and signal interference during signal transmission. Specifically, when the relationship of the first length $L_1$, the second length $L_2$, the first acute angle $\theta_1$, and the second acute angle $\theta_2$ conforms to the first and second formulas E1, E2, the first and second conductive terminals 22, 23 have preferable signal transmission effect.

Please refer to FIGS. 5 and 6. At least part of the outer surface of the first straight segment 222, the portion of the first positioning segment 223 adjacent to the first straight segment 222, at least part of the outer surface of the second straight segment 232, and the portion of the second positioning segment 233 adjacent to the second straight segment 232 are covered by the insulating body 21. The first mating segment 221 and the second mating segment 231 are entirely exposed from the insulating body 21. However, in practical use, the covering type of the insulating body 21 can be adjusted according to the designer's demand. That is to say, the covering type of the insulating body 21 is not limited to the instant embodiment.

For example, the insulating body 21 has a plurality of openings 211. The openings 211 respectively meet part of the outer surface of the first straight segment 222 and part of the outer surface of the second straight segment 232, such that the part of the outer surface of the first straight segment 222 and the part of the outer surface of the second straight segment 232 expose from the insulating body 21 via the respective openings 211. Specifically, the part of the outer surface of the first straight segment 222 and the part of the outer surface of the second straight segment 232 exposed via the respective openings 211 are used to be contacted by a mold (not shown) for fixing position thereof while the insulating body 21 is formed, and the other part of the outer surface of both the first straight segment 222 and the second straight segment 232 are embedded in the insulating body 21.

Moreover, the width $W_{222'}$ of the exposed potion is greater than the width $W_{222}$ of the embedded potion of the outer surface of the first straight segment 222, and the width $W_{232'}$ of the exposed potion is greater than the width $W_{232}$ of the embedded potion of the outer surface of the second straight segment 232. The reason of the design for the widths of the first straight segment 222 is stated as follows. The dielectric constant of the media (i.e., air) that the exposed potion of the outer surface of the first straight segment 222 contacts to is lower than the dielectric constant of the insulating body 21 which is covering the embedded potion of the outer surface of the first straight segment 222, so that the exposed potion of the outer surface of the first straight segment 222 needs to be provided with wider width for ensuring the impedance of each portion thereof are substantially the same, thereby the high frequency property requested by the designer is achieved when transmitting high frequency signal. Similarly, the reason of the design for the widths of the second straight segment 232 is identical to that of the first straight segment 222.

Figure 10:
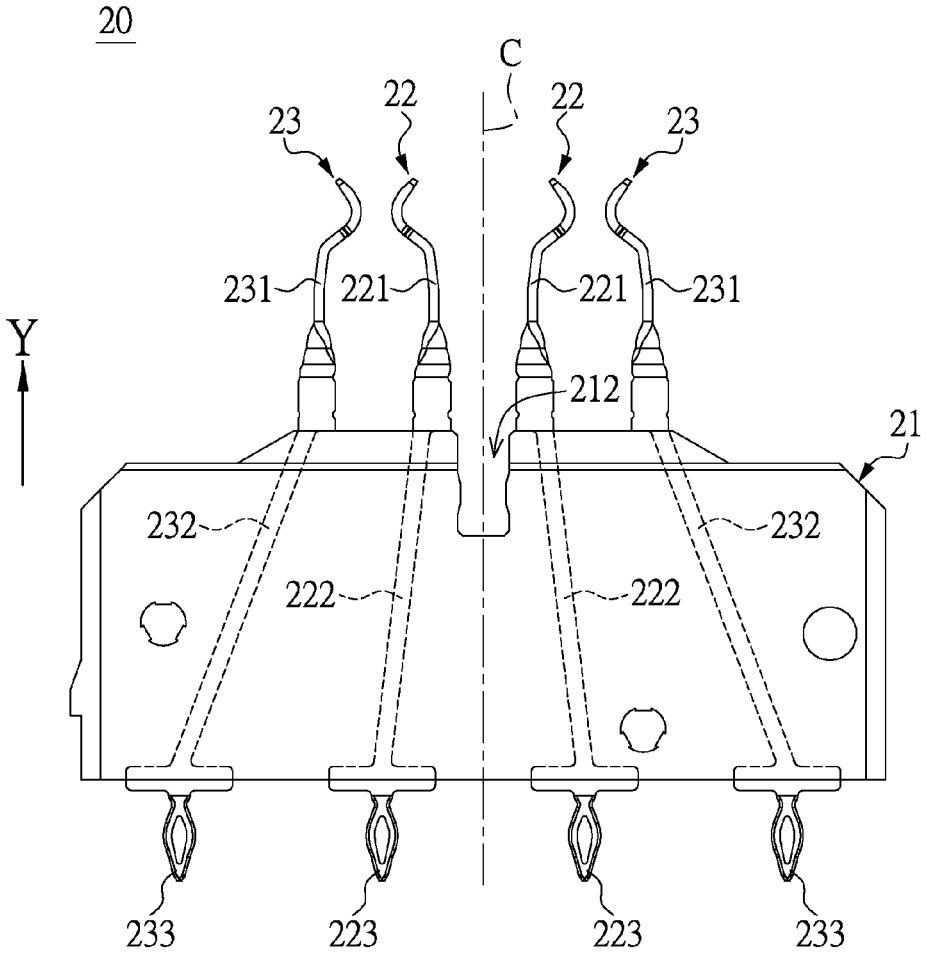
FIG. 10 is a perspective view showing the transmission wafer in another type according to the instant disclosure.

Additionally, the covering type of the insulating body 21 may be designed as shown in FIG. 10. In more detail, the first straight segment 222 and/or the second straight segment 232 are entirely embedded in the insulating body 21, and the first straight segment 222 and/or the second straight segment 232 are designed as elongated structures with identical width.

Please refer to the construction of single transmission wafer 20, the insulating body 21 has a positioning slot 212 concaving along the central axis C between two of the first mating portions 221 in the transmission wafer and arranged between two of the first straight portions 222 therein. The positioning slots 212 of the plurality of stacked transmission wafers 20 are arranged along the coupling direction X to form a recess (not labeled).

Figure 11:
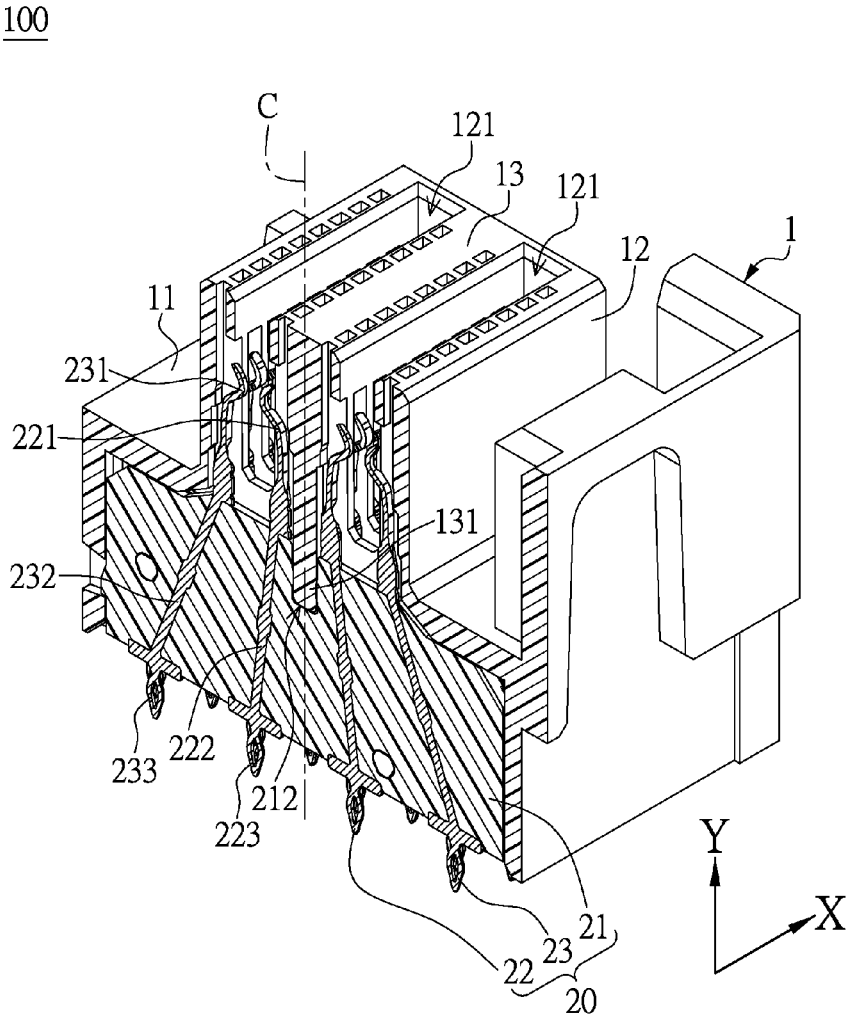
FIG. 11 is a cross-sectional view of FIG. 1.

Please refer to FIGS. 3, 4, and 11. The outer casing 1 has a hollow base portion 11, a hollow inserting portion 12 extended from the base portion 11, and a platy separating portion 13 formed inside the inserting portion 12 and the base portion 11. The inserting portion 12 is divided into two slots 121 by the separating portion 13, and the space surrounded by the base portion 11 connects with the slots 121 of the inserting portion 12. A portion of the separating portion 13 arranged inside the base portion 11 is defined as a positioning rib 131, and the positioning rib 131 is configured to engage with the recess defined by the positioning slots 212 of the stacked transmission wafers 20.

The above description discloses the constructions of the outer casing 1 and each transmission module 2, the following description discloses the relationship between the outer casing 1 and the transmission modules 2. The stacked transmission wafers 20 are inserted into the outer casing 1 along the inserting direction Y, and the positioning rib 131 is engaged to the positioning slots 212 of the stacked transmission wafers 20. At one side of the central axis C, the corresponding first mating segments 221 and the corresponding second mating segments 231 are arranged in one of the slots 121 and exposed from the corresponding slot 121; At another side of the central axis C, the corresponding first mating segments 221 and the corresponding second mating segments 231 are arranged in another slot 121 and exposed from the corresponding slot 121. Moreover, a portion of each first positioning segment 223 and a portion of each second positioning segment 233, which are not covered by the insulating body 21, expose from the outer casing 1 for perpendicularly inserting into a circuit board (not shown).

Each first straight segment 222 and each second straight segment 232 are arranged in the base portion 11. Each first straight segment 222 is formed by extending from one end of the corresponding first mating segment 221 (i.e., the bottom end of the first mating segment 221 as shown in FIG. 11) to one end of the base portion 11 away from the inserting portion 12 (i.e., the bottom end of the base portion 11 as shown in FIG. 11), and each second straight segment 232 is formed by extending from one end of the corresponding second mating segment 231 (i.e., the bottom end of the second mating segment 231 as shown in FIG. 11) to one end of the base portion 11 away from the inserting portion 12 (i.e., the bottom end of the base portion 11 as shown in FIG. 11). Each one of the first and second positioning segments 223, 233 is partially exposed from the base portion 11.

Besides, in a non-shown embodiment, the communication connector 100 could be provided without the insulating body 21. Specifically, in the non-shown embodiment, each transmission wafer 20 only has the first conductive terminals 22 and the second conductive terminals 23, and the first conductive terminals 22 and the second conductive terminals 23 are positioned on the outer casing 1.

[The Probable Effect of the Above Embodiments]

Base on the above disclosure, the portions of the first and second conductive terminals embedded in the insulating body are respectively formed to be straight as the first and second straight segments, so that the first and second conductive terminals are easily to align when disposed in the mold, thereby simplifying the construction of the mold for forming the insulating body. Furthermore, the signal transmission of the communication connector can achieve the designer's demand by the relative design of the first and second straight segments (e.g., the first acute angle smaller than the second acute angle) provided from the instant embodiment.

Moreover, the first straight segment and the second straight segment do not have any curve portion, such that the energy loss and signal interference can be reduce in said straight segments during signal transmission. Specifically, when the relationship of the first length, the second length, the first acute angle, and the second acute angle conforms to the first and second formulas aforementioned, the first and second conductive terminals would have preferable signal transmission effect.

Additionally, when the insulating body is formed to cover part of each first conductive terminal and part of each conductive terminal, the mold flow is more uniform to reduce the probability of the warping deformation of the insulating body by means of the first conductive terminals respectively arranged at two opposing sides of the central axis and the second conductive terminals respectively arranged at two opposing outer sides of the first conductive terminals.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A communication connector, comprising:

an outer casing having a base portion and an inserting portion extended from the base portion, wherein a space surrounded by the base portion is communicated with a space surrounded by the inserting portion; and a plurality of transmission wafers stacked and arranged in one row, the stacked transmission wafers inserted into the outer casing and defining with an inserting direction, thereby a mating connector could be inserted into the inserting portion along the inserting direction and to contact the transmission wafers, wherein each transmission wafer comprising:

at least one first conductive terminal having a first mating segment, a first straight segment, and a first positioning segment, wherein a longitudinal direction of the first mating segment is approximately parallel to the inserting direction, the first mating segment is arranged in the inserting portion and exposed from the inserting portion, wherein the first straight segment is arranged in the base portion and extended from the first mating segment to one end of the base portion away from the inserting portion, a first acute angle is defined by the first straight segment and the inserting direction, and wherein the first positioning segment is extended from the first straight segment and at least partially exposed from the base portion; and at least one second conductive terminal having a second mating segment, a second straight segment, and a second positioning segment, wherein a longitudinal direction of the second mating segment is approximately parallel to the inserting direction, the second mating segment is arranged in the inserting portion and exposed from the inserting portion, wherein the second straight segment is arranged in the base portion and extended from the second mating segment to one end of the base portion away from the inserting portion, a second acute angle is defined by the second straight segment and the inserting direction, and wherein the second positioning segment is extended from the second straight segment and at least partially exposed from the base portion, wherein the first conductive terminal and the second conductive terminal are substantially in coplanar arrangement, the first acute angle is smaller than the second acute angle; two virtual lines respectively defined by extending from the first and second straight segments along the longitudinal directions thereof are intersecting to form an angle, and wherein the angle is the difference of the first and second acute angles.

2. The communication connector as claimed in claim 1, wherein each transmission wafer has a sheet-like insulating body; at each transmission wafer, at least part of the outer surface of the first straight segment and at least part of the outer surface of the second straight segment are covered by the insulating body, wherein the first conductive terminals in at least two adjacent transmission wafers of the plurality of transmission wafers face each other and are coupled together so as to carry differential signals thereacross, and the second conductive terminals in at least two adjacent transmission wafers of the plurality of transmission wafers face each other and are coupled together so as to carry differential signals thereacross.

3. The communication connector as claimed in claim 2, wherein at each transmission wafer, the insulating body has a plurality of openings, at least part of the outer surface of the first straight segment and at least part of the outer surface of the second straight segment are exposed from the insulating body via the openings, the width of the exposed potion of the outer surface of the first straight segment is greater than the width of the covered potion of the outer surface of the first straight segment, the width of the exposed potion of the outer surface of the second straight segment is greater than the width of the covered potion of the outer surface of the second straight segment.

4. The communication connector as claimed in claim 2, wherein at each transmission wafer, the first straight segment and the second straight segment are entirely embedded in the insulating body, the first straight segment of the first conductive terminal is an elongated structure with identical width, the second straight segment of the second conductive terminal is an elongated structure with identical width.

5. The communication connector as claimed in claim 2, wherein at each transmission wafer, the first mating segment of and the second mating segment are entirely exposed from the insulating body.

6. The communication connector as claimed in claim 2, wherein the first straight segment has a first length, the second straight segment has a second length, wherein the relationship of the first length, the second length, the first acute angle, and the second acute angle conforms to at least one of the formulas as following:

$$L_2 \sin \theta_2 = NL_1 \sin \theta_1; \text{ and}$$

$$L_1 \cos \theta_1 = L_2 \cos \theta_2,$$

Wherein $L_1$ is the first length, $L_2$ is the second length, $\theta_1$ is the first acute angle, $\theta_2$ is the second acute angle, and $2 \leq N \leq 5$.

7. The communication connector as claimed in claim 2, wherein the width of each the first straight segment is narrower than the width of a portion of the first mating segment and the first positioning segment adjacent thereto, the width of each the second straight segment is narrower than the width of a portion of the second mating segment and the second positioning segment adjacent thereto.

8. The communication connector as claimed in claim 1, wherein each transmission wafer defines a central axis; and each transmission wafer is configured with two first conductive terminals and two second conductive terminals, wherein the two first conductive terminals are arranged mirror symmetrically to the central axis, and the two second conductive terminals are also arranged mirror symmetrically to the central axis.

9. The communication connector as claimed in claim 6, wherein the outer casing has a separating portion formed inside the inserting portion and the base portion, the inserting portion is divided into two slots by the separating portion, a portion of the separating portion arranged inside the base portion is defined as a positioning rib; each transmission wafer has a sheet-like insulating body; wherein at each transmission wafer, at least part of the outer surface of each first straight segment and at least part of the outer surface of each second straight segment are covered by the insulating body, the insulating body has a positioning slot concaving along the central axis from a portion between the first mating portions and arranged between the first straight portions; and wherein the separating portion of the outer casing inserts into the positioning slots of the transmission wafers.

10. The communication connector as claimed in claim 8, wherein the first straight segment of each first conductive terminal has a first length, the second straight segment of each second conductive terminal has a second length, wherein the relationship of the first length, the second length, the first acute angle, and the second acute angle conforms to at least one of the formulas as following:

$$L_2 \sin \theta_2 = NL_1 \sin \theta_1; \text{ and}$$

$$L_1 \cos \theta_1 = L_2 \cos \theta_2,$$

Wherein $L_1$ is the first length, $L_2$ is the second length, $\theta_1$ is the first acute angle, $\theta_2$ is the second acute angle, and $2 \leq N \leq 5$.

11. The communication connector as claimed in claim 8, wherein the width of each the first straight segment is narrower than the width of a portion of the first mating segment and the first positioning segment adjacent thereto, the width of each the second straight segment is narrower than the width of a portion of the second mating segment and the second positioning segment adjacent thereto.

12. The communication connector as claimed in claim 1, wherein each the first straight segment has a first length, and each the second straight segment has a second length, wherein the relationship of the first length, the second length, the first acute angle, and the second acute angle conforms to a formula, and wherein the formula is $L_2 \sin \theta_2 = NL_1 \sin \theta_1$, $L_1$ is the first length, $L_2$ is the second length, $\theta_1$ is the first acute angle, $\theta_2$ is the second acute angle, and $2 \leq N \leq 5$.

13. The communication connector as claimed in claim 1, wherein each the first straight segment has a first length, and each the second straight segment has a second length, wherein the relationship of the first length, the second length, the first acute angle, and the second acute angle conforms to a formula, and wherein the formula is $L_1 \cos \theta_1 = L_2 \cos \theta_2$, $L_1$ is the first length, $L_2$ is the second length, $\theta_1$ is the first acute angle, and $\theta_2$ is the second acute angle.

14. The communication connector as claimed in claim 1, wherein the width of each the first straight segment is narrower than the width of a portion of the first mating segment adjacent thereto, the width of each the second straight segment is narrower than the width of a portion of the second mating segment adjacent thereto.

15. The communication connector as claimed in claim 1, wherein the communication connector is further limited to a mini SAS HD connector.

16. A transmission wafer of a communication connector, defining an inserting direction for providing a mating connector to insert into the transmission wafer along the inserting direction, comprising:

at least one first conductive terminal integrally formed in one piece and having a first mating segment, a first straight segment, and a first positioning segment in sequence, wherein a longitudinal direction of the first mating segment is approximately parallel to the inserting direction, the first straight segment is extended from the first mating segment along a first acute angle defined by the first straight segment and the inserting direction, the first positioning segment is extended from the first straight segment;

at least one second conductive terminal integrally formed in one piece and having a second mating segment, a second straight segment, and a second positioning segment in sequence, wherein a longitudinal direction of the second mating segment is approximately parallel to the inserting direction, the second straight segment is extended from the second mating segment along a second acute angle defined by the second straight segment and the inserting direction, the second positioning segment is extended from the second straight segment; and an insulating body covering at least part of the outer surface of the first straight segment of the first conductive terminal and at least part of the outer surface of the second straight segment of the second conductive terminal, thereby maintaining the relative position of the first and second conductive terminals, wherein the first conductive terminal and the second conductive terminal are substantially in coplanar arrangement, the first acute angle is smaller than the second acute angle; two virtual lines respectively defined by extending from the first and second straight segments along the longitudinal directions thereof are intersecting to form an angle, and wherein the angle is the difference of the first and second acute angles.

17. The transmission wafer as claimed in claim 16, wherein the first straight segment of the first conductive terminal has a first length, the second straight segment of the second conductive terminal has a second length, wherein the relationship of the first length, the second length, the first acute angle, and the second acute angle conforms to a formula, wherein the formula is $L_2 \sin \theta_2 = NL_1 \sin \theta_1$, $L_1$ is the first length, $L_2$ is the second length, $\theta_1$ is the first acute angle, $\theta_2$ is the second acute angle, and $2 \leq N \leq 5$.

18. The transmission wafer as claimed in claim 17, wherein the relationship of the first length, the second length, the first acute angle, and the second acute angle conforms to a formula, wherein the formula is $L_1 \cos \theta_1 = L_2 \cos \theta_2$.

19. The transmission wafer as claimed in claim 16, wherein the width of the first straight segment is narrower than the width of a portion of the first mating segment adjacent thereto, the width of the second straight segment is narrower than the width of a portion of the second mating segment adjacent thereto.

* * * * *